US007806565B2

(12) United States Patent
Lu et al.

(10) Patent No.: US 7,806,565 B2
(45) Date of Patent: Oct. 5, 2010

(54) SAFE LIGHT EMITTING DEVICE

(75) Inventors: Hou-Chen Lu, Taipei Hsien (TW); Kai Huang, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 282 days.

(21) Appl. No.: 12/055,590

(22) Filed: Mar. 26, 2008

(65) Prior Publication Data

US 2009/0103309 A1 Apr. 23, 2009

(30) Foreign Application Priority Data

Oct. 17, 2007 (CN) ..... 2007 1 0202112

(51) Int. Cl.
*F21V 7/06* (2006.01)
*F21V 7/00* (2006.01)

(52) U.S. Cl. ..... 362/296.07; 362/296.01; 362/390; 362/442; 313/552

(58) Field of Classification Search ..... 362/296.07, 362/296.01, 390, 442; 313/552
See application file for complete search history.

(56) References Cited

U.S. PATENT DOCUMENTS

| | | | | |
|---|---|---|---|---|
| 1,875,550 | A * | 9/1932 | Barnes | 362/296.07 |
| 2,257,419 | A * | 9/1941 | Kurz | 362/307 |
| 2,805,327 | A * | 9/1957 | Gerstel | 362/296.07 |
| 4,428,039 | A | 1/1984 | Guimond et al. | |
| 4,536,828 | A * | 8/1985 | Mori | 362/558 |
| 5,133,328 | A * | 7/1992 | Sato et al. | 123/627 |
| 5,528,479 | A * | 6/1996 | Chen | 362/410 |
| 7,307,376 | B2 * | 12/2007 | Koegler et al. | 313/113 |

* cited by examiner

*Primary Examiner*—Stephen F Husar
*Assistant Examiner*—James W Cranson
(74) *Attorney, Agent, or Firm*—Andrew C. Cheng

(57) ABSTRACT

A safe light emitting device includes a reflective housing with an open end, a support coupled to the reflective housing, a holder, and a lamp. The holder is positioned on the support and is remote from the open end of the reflective housing. The lamp includes a bulb and a connector connecting the bulb to the holder. The bulb defines a concavity in an outer surface thereof.

10 Claims, 3 Drawing Sheets

SAFE LIGHT EMITTING DEVICE

BACKGROUND

1. Technical Field

The present invention relates to light emitting devices and, particularly, to a safe light emitting device filled with high-pressure gas.

2. Description of Related Art

Nowadays, many light emitting devices are gas-filled types. A gas-filled light emitting device generally comprises a filament and a bulb housing the filament. When the light emitting device has been operating for a comparatively long period of time, the internal pressure within the bulb can become greater than one atmosphere, possibly reaching several atmospheres. The high internal pressure within the bulb poses a danger to persons or property in the immediate area of the light emitting device, should the bulb break.

What is needed, therefore, is a safe light emitting device.

SUMMARY

In accordance with a present embodiment, a safe gas-filled light emitting device includes a reflective housing with an open end, a support coupled to the reflective housing, a holder, and a lamp. The holder is positioned on the support and is remote from the open end of the reflective housing. The lamp includes a bulb and a connector connecting the bulb to the holder. The bulb defines a concavity in an outer surface thereof.

Other advantages and novel features will be drawn from the following detailed description of at least one preferred embodiment, when considered in conjunction with the attached drawings.

BRIEF DESCRIPTION OF THE DRAWINGS

Many aspects of the present safe light emitting device can be better understood with reference to the following drawings. The components in the drawings are not necessarily drawn to scale, the emphasis instead being placed upon clearly illustrating the principles of the present safe light emitting device. Moreover, in the drawings, like reference numerals designate corresponding parts throughout the several views.

DETAILED DESCRIPTION OF THE EMBODIMENTS

Embodiments of the present safe light emitting device will now be described in detail below and with reference to the drawings.

Figure 1:
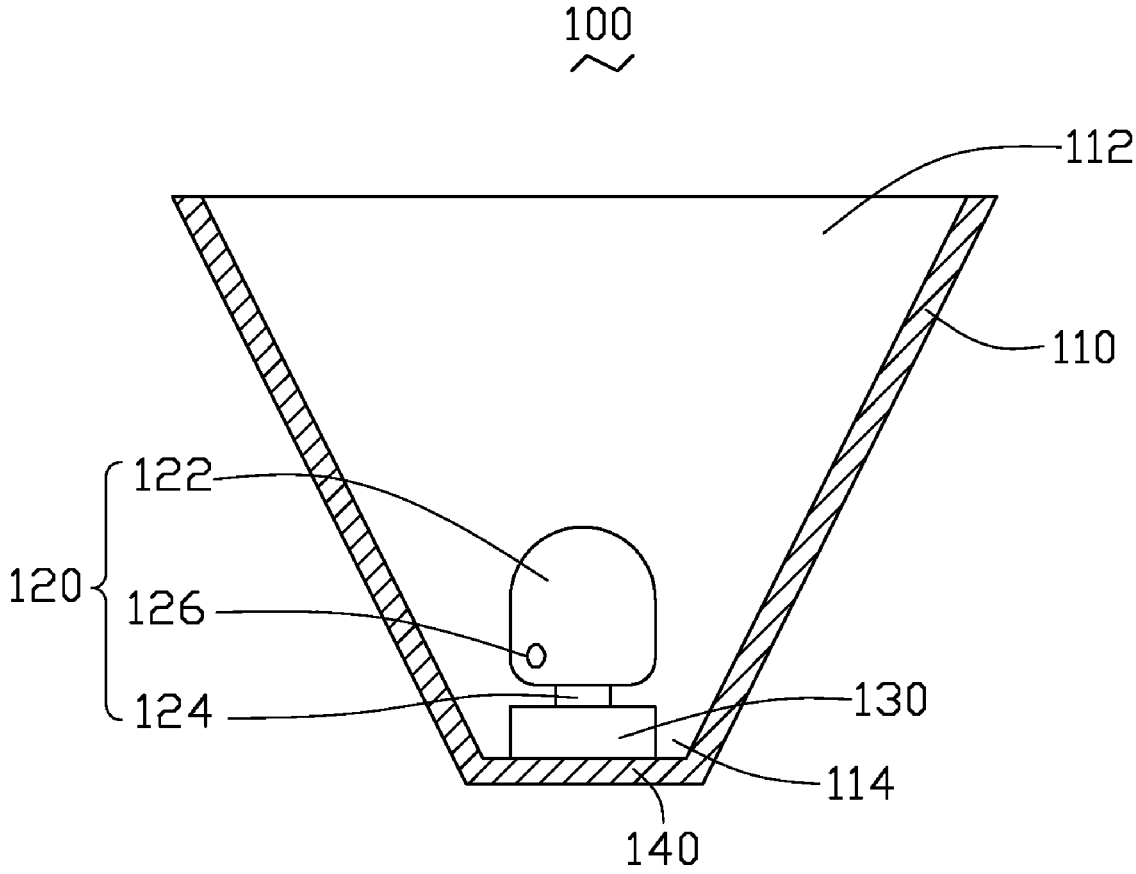
FIG. 1 is a schematic, cross-sectional view of a gas-filled safe light emitting device, according to a present first embodiment.

Referring to FIG. 1, a gas-filled safe light emitting device 100 in accordance with a present first embodiment is illustrated. The device 100 comprises a reflective housing 110, a lamp 120, a holder 130, and a support 140. The lamp 120 is positioned to the holder 130. The housing 110 houses the lamp 120 and the holder 130 therein. The support 140 is integrally formed with the housing 110.

The housing 110 is in a shape of an inverted truncated cone, with the wide top end thereof designated as a first end 112 and the narrow bottom thereof designated as a second end 114. The first end 112 of the housing 110 is open for allowing light from the lamp 120 to be emitted therefrom; the second end 114 is sealed by the support 140, which receives the holder 130 engaged thereon. The support 140 is a plate integrally formed at the second end 114 in the embodiment.

The lamp 120 comprises a bulb 122 with a filament (not shown) therein, and a connector 124 for mechanically connecting the bulb 122 to the holder 130. The bulb 122 is oriented toward the open first end 112 of the housing 110, after the lamp 120 is mounted to the holder 130. A circular concavity 126 is defined in an outer surface of the bulb 122, near the holder 130 and remote from the open first end 112.

The concavity 126 in the outer surface thereof, provides a weak location for cracking of the bulb 122 to occur at when pressure in the bulb 122 is too great which allows explosive decompression to be directed towards away from the open end 112 within the housing 110. Therefore, danger to persons or property in the immediate area of the light emitting device 100 is eliminated or at least reduced in the case of explosive decompression of the bulb 122.

Figure 2:
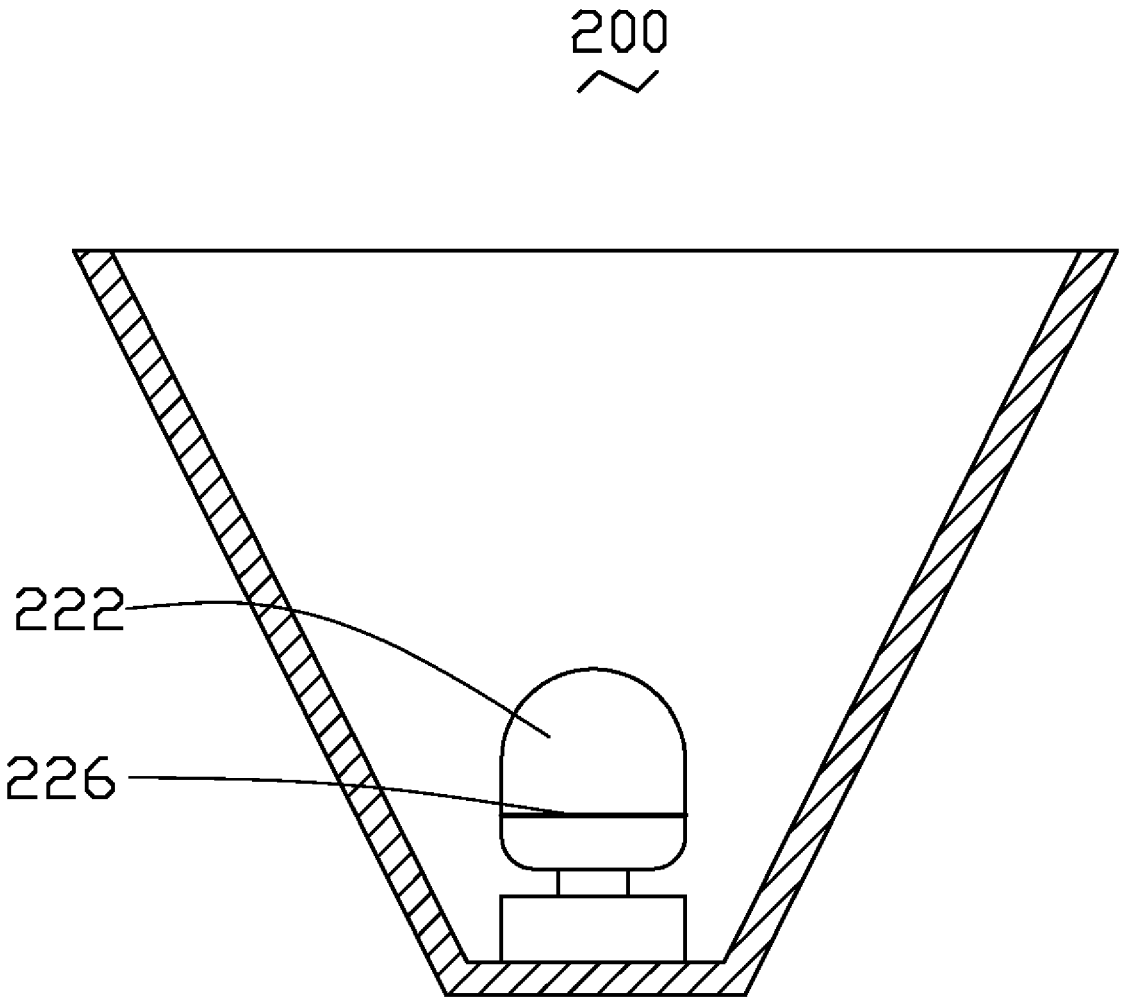
FIG. 2 is a schematic, cross-sectional view of a gas-filled safe light emitting device, according to a present second embodiment.

Referring to FIG. 2, a gas-filled safe light emitting device 200 in accordance with a present second embodiment is illustrated. The light emitting device 200 is similar to the light emitting device 100; however, the light emitting device 200 has a concavity 226 encircling a bulb 222 near an end of the bulb 222 away from an opening (not labeled) of the light emitting device 200. Other features of the light emitting device 200 can be referenced from the description of the light emitting device 100 of the first embodiment.

Figure 3:
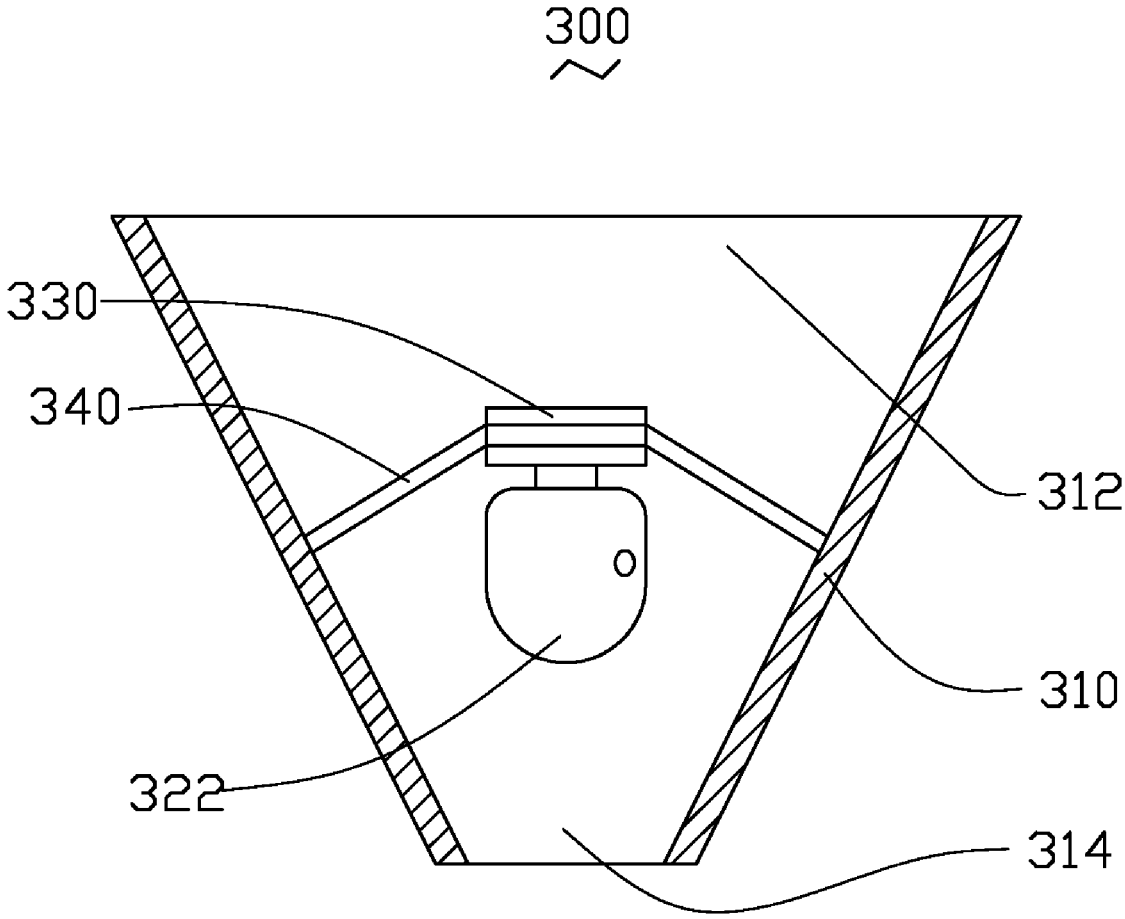
FIG. 3 is a schematic, cross-sectional view of a gas-filled safe light emitting device, according to a present third embodiment.

Referring to FIG. 3, a gas-filled safe light emitting device 300 in accordance with a present third embodiment is illustrated. The light emitting device 300 is similar to the light emitting device 100. However, the light emitting device 300 has a support 340 positioned approximately midway between first and second ends 312, 314 of a reflective housing 310 of the light emitting device 300. The support 340 is an umbrella-like frame, including several rigid bars positioned on the housing 310. The light emitting device 300 has its holder 330 positioned at a tip of the support 340. The light emitting device 300 has its bulb 322 oriented toward the second end 314. Other features of the light emitting device 300 can be referenced from the description of the light emitting device 100 of the first embodiment.

It is to be understood that the concavities in the light emitting devices can be configured in any other suitable shapes, such as triangles, or ellipses, or configured as unclosed curved lines. It is also to be understood that the reflective housings of the light emitting devices can be configured to be a cylinder, or a parabolic column.

It will be understood that the above particular embodiments and methods are shown and described by way of illustration only. The principles and features of the present invention may be employed in various and numerous embodiments thereof without departing from the scope of the invention as claimed. The above-described embodiments illustrate the scope of the invention but do not restrict the scope of the invention.

What is claimed is:

1. A safe light emitting device comprising:

a reflective housing comprising an open end;

a support coupled to the reflective housing;

a holder positioned on the support and remote from the open end of the reflective housing; and a lamp comprising a bulb and a connector connecting the bulb to the holder, the bulb defining a concavity in an outer surface thereof.

2. The safe light emitting device as claimed in claim 1, wherein the concavity is located near the holder.

3. The safe light emitting device as claimed in claim 1, wherein the concavity is circular.

4. The safe light emitting device as claimed in claim 1, wherein the concavity encircles the bulb.

5. The safe light emitting device as claimed in claim 1, wherein the bulb is oriented toward the open end of the reflective housing.

6. The safe light emitting device as claimed in claim 1, wherein the support is a plate formed at an additional end of the reflective housing and opposite to the open end of the reflective housing.

7. The safe light emitting device as claimed in claim 1, wherein the support is an umbrella-like frame including several rigid bars positioned on the reflective housing.

8. The safe light emitting device as claimed in claim 7 wherein the reflective housing comprises an additional end opposite to the open end, and the support is positioned midway between the open end and the additional end of the reflective housing.

9. The safe light emitting device as claimed in claim 8, wherein the holder is positioned at a tip of the support.

10. The safe light emitting device as claimed in claim 8, wherein the bulb is oriented toward the additional end of the reflective housing.

* * * * *